United States Patent [19]

Foerg et al.

[11] Patent Number: 4,488,890

[45] Date of Patent: Dec. 18, 1984

[54] LOW TEMPERATURE SEPARATION OF GASEOUS MIXTURE FOR METHANOL SYNTHESIS

[75] Inventors: Wolfgang Foerg, Darien, Conn.; Walter Scholz, Wolfratshausen; Freimut Marold, Neubiberg, both of Fed. Rep. of Germany

[73] Assignee: Linde Aktiengesellschaft, Wiesbaden, Fed. Rep. of Germany

[21] Appl. No.: 564,868

[22] Filed: Dec. 23, 1983

[30] Foreign Application Priority Data

Dec. 23, 1982 [DE] Fed. Rep. of Germany ..... 3247782

[51] Int. Cl.[3] ..... F25J 3/00; B01D 47/00

[52] U.S. Cl. ..... 62/17; 55/48; 55/68; 62/20; 62/27

[58] Field of Search ..... 55/46, 48, 51, 68; 62/17, 20, 24, 27, 28

[56] References Cited

U.S. PATENT DOCUMENTS

| | | | |
|---|---|---|---|
| 3,649,558 | 3/1972 | Linde et al. | 62/28 X |
| 4,102,659 | 7/1978 | Martin | 62/17 |
| 4,311,496 | 1/1982 | Fabian | 62/17 |
| 4,337,072 | 6/1982 | McNeil | 62/24 X |
| 4,338,107 | 7/1982 | Swallow | 62/17 |

*Primary Examiner*—Charles Hart

*Attorney, Agent, or Firm*—Millen & White

[57] ABSTRACT

For the low-temperature separation of a gaseous mixture containing essentially hydrogen, $C_{1+}$-hydrocarbons, and carbon monoxide, resulting in a purified gaseous mixture to be processed, after the low-temperature separation, in methanol synthesis, the gaseous mixture is cooled and subsequently fed to a scrubbing column to scrub out the $C_{1+}$-hydrocarbons with liquid CO. A product containing essentially hydrogen and carbon monoxide is obtained at the head of the scrubbing column. The resultant liquid CO, loaded essentially with the $C_{1+}$-hydrocarbons, is withdrawn as the sump product from the column and introduced into a $C_{1+}$-CO separating column.

14 Claims, 1 Drawing Figure

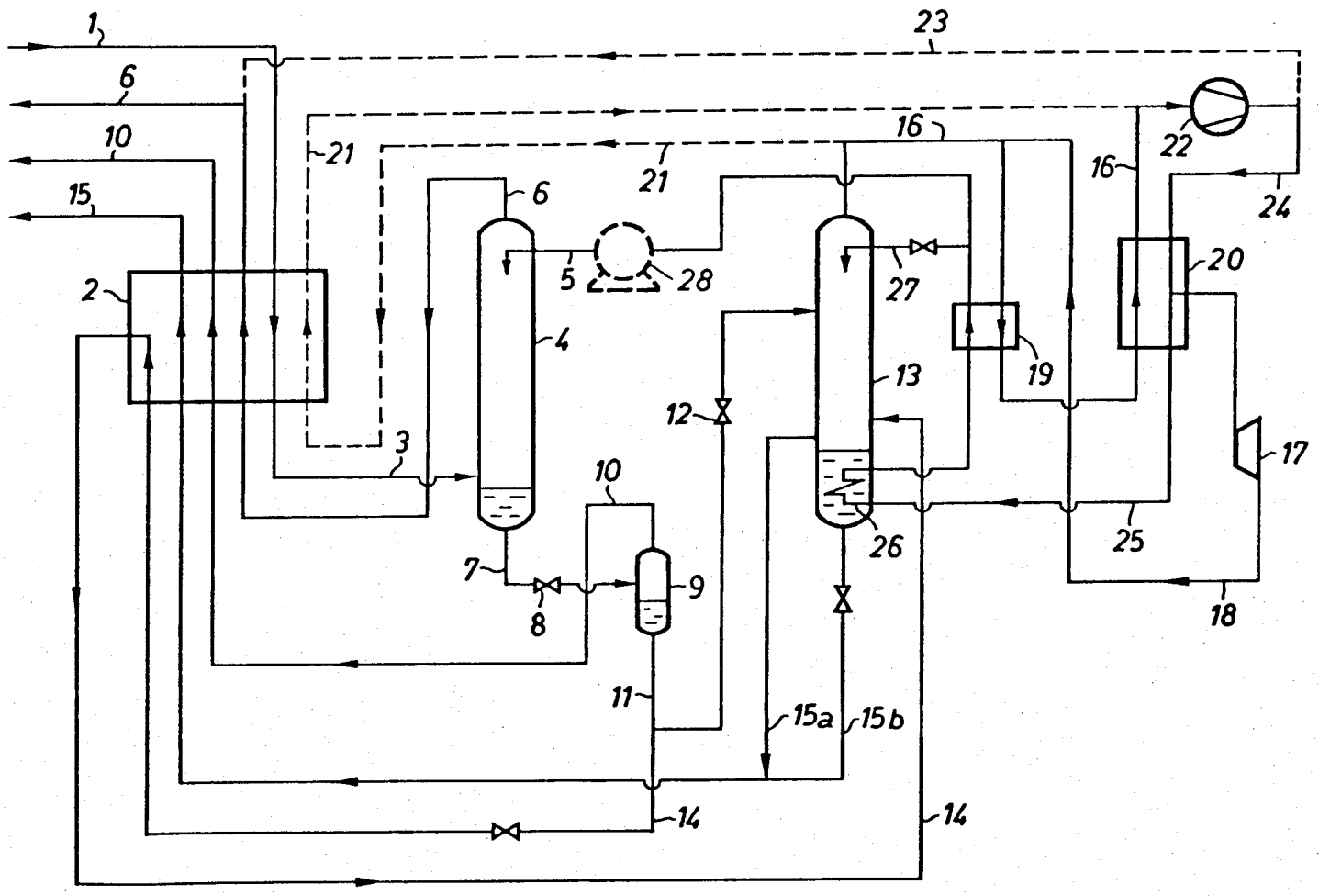
1
2
3
4
5
6
7
8
9
10
11
12
13
14
15
15a
15b
16
17
18
19
20
21
22
23
24
25
26
27
28

LOW TEMPERATURE SEPARATION OF GASEOUS MIXTURE FOR METHANOL SYNTHESIS

BACKGROUND OF THE INVENTION

This invention relates to a low-temperature separation process for removing most of the $C_{1+}$ hydrocarbons from a gaseous mixture containing essentially hydrogen, $C_{1+}$-hydrocarbons, and carbon monoxide, the resultant mixture being useful for further processing in a methanol synthesis plant. By $C_{1+}$ hydrocarbons is meant gaseous hydrocarbons predominating in methane.

Such a process has been known, for example, from "Linde-Berichte aus Technik und Wissenschaft" [Linde Reports on Science and Technology] 51 : 7–9 (1982). Gas subjected to preliminary purification, i.e. gas freed of $CO_2$, $H_2S$ and in some cases COS, is cooled, after adsorptive removal of trace impurities, to such an extent that CO, as well as the associated components Ar, $N_2$, and $CH_4$ are condensed out. The condensate is fed to a hydrogen stripper to separate dissolved hydrogen. The degasified condensate is then introduced into a methane-CO separating column. The methane obtained as the sump product is discharged as fuel gas. Pure CO, withdrawn from the head of the separating column, is compressed to the discharge pressure after heating. A CO cycle stream is returned into the process and liquefied. This stream serves, in part, as reflux for the methane-CO separating column and, in part, as refrigerant. In this process, the carbon monoxide contained in the crude gas is obtained separately from hydrogen under reduced pressure, e.g., 5 to 30 bar, and is recompressed to syngas pressure. However, if the CO obtained during the low-temperature separation is to be utilized for methanol synthesis, this represents an additional energy requirement.

SUMMARY

An object of the present invention is to provide an improved process enabling the carbon monoxide to remain in an energetically advantageous and cost-saving manner to the greatest extent possible, at the gas pressure to be used for methanol synthesis.

Another object is to minimize the proportion of carbon monoxide separated with the $C_{1+}$-hydrocarbons and obtained under reduced pressure.

Upon further study of the specification and appended claims, further objects and advantages of this invention will become apparent to those skilled in the art.

To attain these objects, the process of the present invention comprises a process for the separation of a gaseous mixture, containing essentially hydrogen, $C_{1+}$-hydrocarbons, and carbon monoxide, at low temperatures, into a gas depleted in $C_{1+}$-hydrocarbons and useful for further processing in methanol synthesis, said process comprising scrubbing the gaseous mixture with liquid CO in a scrubbing column to scrub out the $C_{1+}$-hydrocarbons to form a head product which contains essentially hydrogen and carbon monoxide; withdrawing the liquid CO, containing $C_{1+}$-hydrocarbons, as a sump product from the column, and passing said sump product into a $C_{1+}$-CO separating column to remove the CO as gaseous head product.

In general, the pressure of the gaseous mixture entering the scrubbing step is normally about 10 to 75 bar.

It has been found that, with the use of a CO scrubbing step, the carbon monoxide concentration in the crude gas can be substantially maintained in the scrubbed gas so that the molar ratio of $H_2$:CO is about 2:1 to 2,6:1 in both gases. In this connection, the head temperature of the scrubbing column is higher, e.g., about 100 to 108 K. and thus can be set more favorably from an energy viewpoint. Furthermore, the proportion of carbon monoxide to be separated from the $C_{1+}$-hydrocarbons is substantially reduced, resulting in a smaller separating column and a lower energy requirement.

According to a preferred aspect of the invention, the liquid CO utilized is supplied by a CO cycle, e.g., comprising a compressor and an expansion machine.

Preferably, the $C_{1+}$-hydrocarbons are scrubbed out to a residual content in the product gas of about 0.05–0.2 mol-%, preferably 0.08–0.12 mol-%. The head product obtained in this way can therefore be directly fed to a methanol synthesis installation.

According to another advantageous embodiment of the process of this invention, the sump product of the scrubbing column is expanded to an intermediate pressure, e.g., 5 to 10 bar, set in such a way that by this mode of operation, residual dissolved proportions of hydrogen are extensively removed before separating the CO from the $C_{1+}$-hydrocarbons. The thus-liberated, gaseous fraction is withdrawn and optionally recycled into the crude gas. The remaining liquid is introduced into the $C_{1+}$-CO separating column. To remove dissolved hydrogen even more completely from the liquid, liquid at the intermediate pressure is also heated.

The CO withdrawn as the head product from the $C_{1+}$-CO separating column is heated, compressed, and after recooling utilized, in part, as the reboiler heat for the separating column and, in part, for producing refrigeration. In particular, the CO stream condensed during heating of the separating column is used as reflux liquid for both the scrubbing column and for the $C_{1+}$-CO separating column.

In case the process pressure in the scrubbing column lies above the CO cycle pressure, the latter being adjusted in order to comply with the requirements of the sump heating operation in the separating column, it is provided according to this invention that the pressure of the liquid CO is raised, prior to being fed into the scrubbing column, to the process pressure that is higher than that of the cycle CO.

Furthermore, there is the possibility of obtaining a precondensate enriched with $C_{1+}$-hydrocarbons during the pre-cooling of the gaseous mixture, and to introduce this precondensate separately into the $C_{1+}$-CO separating column. This feature affords improvements in the rectification conditions and thus savings in energy consumption during $C_{1+}$-CO separation.

Moreover, to reduce the hydrogen and carbon monoxide content in the sump product of the scrubbing column, the sump product is heated by means of crude gas or CO cycle gas.

The process of this invention is utilized especially in obtaining a methane-free $H_2$-CO mixture from crude methanol synthesis gas, with "methane-free" being defined above with respect to permissible residual properties. Crude methanol synthesis gas generally contains about 5 to 20 mol %, especially 15 mol % methane, depending on the kind of gasification. The temperature of the crude methanol synthesis gas is about 210 to 250 K., the pressure lies between 20 and 75 bar.

BRIEF DESCRIPTION OF DRAWINGS

The attached drawing is a schematic flowsheet of the preferred comprehensive embodiment of the invention and is to be read in conjunction with the material balance in the Table following the detailed description thereof.

DETAILED DESCRIPTION OF PREFERRED EMBODIMENT

Crude gas, free of $CO_2$ and $H_2O$, which contains essentially hydrogen, $C_{1+}$-hydrocarbons, and carbon monoxide, is introduced via conduit 1 and cooled in a heat exchanger 2 against cold separation products. During this step, partial condensation of the $C_{1+}$-hydrocarbons occurs.

The cooled gaseous stream then enters via conduit 3 into a scrubbing column 4 at a temperature of about 108 K. and a pressure of about 28 bar. Liquid CO from conduit 5 is introduced at the head of the scrubbing column at a temperature of about 100 K. The liquid CO absorbs $C_{1+}$-hydrocarbons from the upwardly flowing gas, along with some hydrogen and inert compounds, such as nitrogen. Via conduit 6, a head product is withdrawn from the head of the scrubbing column 4 which contains essentially hydrogen and carbon monoxide as well as still about 0.1 mol-% of $C_{1+}$-hydrocarbons; this head product is then introduced into a methanol synthesis facility.

The sump product from scrubbing column 4 is discharged via conduit 7, expanded (8) into an intermediate pressure of about 6 bar, and passed to a phase separator 9. The hydrogen-rich gas liberated during expansion is discharged via conduit 10. The remaining liquid, essentially $C_{1+}$-hydrocarbons and CO, is, in part, fed directly to a separating column 13 by way of conduit 11 after further expansion (12) to about 3 bar. Another part, e.g., 30 to 40% of the liquid is likewise fed into the separating column 13 via conduit 14 after partial evaporation in heat exchanger 2.

From the sump of this separating column 13, the pure $C_{1+}$-hydrocarbons are withdrawn, via conduits 15*a* and 15*b*, partially in the gaseous phase and partially in the liquid phase, and discharged as SNG.

The head product in conduit 16 of the separating column is CO. The largest portion, e.g., 80 to 100% of CO is heated by way of conduit 16, in heat exchangers 19 and 20 together with expansion gas from an expansion turbine 17 and conduit 18. The other portion can be heated in heat exchanger 2 by way of conduit 21. After heating, the CO is compressed in compressor 22 and mostly returned into the installation. A small, e.g., 0 to 20%, partial stream can be admixed via conduit 23 with the methanol synthesis gas for fine adjustment of the synthesis gas composition in conduit 6.

The compressed CO cycle stream in conduit 24 serves, after cooling in heat exchanger 20, partially for producing refrigeration in the expansion turbine 17, and partially, e.g., about 75 to 90%, via conduit 25 for heating the separating column 13. The CO stream condensed in the reboiler 26 of separating column 13 constitutes the reflux liquids for the two columns 13 and 4 by way of conduits 27 and 5, respectively. If desired, the pressure of the CO fed into the scrubbing column 4 via conduit 5 can be raised to the process pressure by means of a pump 28, shown in dashed lines.

The following Table is a compilation of the material balance for the process of this invention, wherein mol/s represents mol/second, and SNG stands for substitute natural gas.

TABLE

| | CRUDE GAS | | SNG | | METHANOL SYNTHESIS GAS | | EXPANSION GAS | |
|---|---|---|---|---|---|---|---|---|
| | % | mol/s | % | mol/s | % | mol/s | % | mol/s |
| $H_2$ | 59.32 | 1,472.5 | — | — | 71.48 | 1,452.51 | 40.29 | 19.99 |
| $N_2$ | 0.20 | 5.0 | 1 ppm | — | 0.23 | 4.75 | 0.50 | 0.25 |
| CO | 24.17 | 600.0 | 1.30 | 5.2 | 28.00 | 569.08 | 51.84 | 25.72 |
| Ar | 0.20 | 5.0 | 0.20 | 0.8 | 0.20 | 4.02 | 0.36 | 0.18 |
| $CH_4$ | 16.11 | 400.0 | 98.50 | 394.7 | 0.09 | 1.82 | 7.01 | 3.48 |
| | | 2,482.5 | | 400.7 | | 2,032.18 | | 49.62 |
| T (K) | 215 | | 212 | | 212 | | 212 | |
| p (bar) | 28.0 | | 2.0 | | 26.5 | | 5.5 | |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for the separation of a gaseous mixture, containing essentially hydrogen, $C_{1+}$-hydrocarbons, and carbon monoxide, at low temperatures, into a gas depleted in $C_{1+}$-hydrocarbons and useful for further processing in methanol synthesis, said process comprising scrubbing the gaseous mixture with liquid CO in a scrubbing column to scrub out the $C_{1+}$-hydrocarbons to form a head product which contains essentially hydrogen and carbon monoxide; withdrawing the liquid CO, containing $C_{1+}$-hydrocarbons, as a sump product from the column, and passing said sump product into a $C_{1+}$-CO separating column to remove the CO as gaseous head product.

2. A process according to claim 1, wherein the liquid CO is obtained from a CO cycle comprising compressing the gaseous CO head product and engine expanding resultant compressed CO.

3. A process according to claim 1, wherein said $C_{1+}$-hydrocarbons are scrubbed down to a residual content of 0.05–0.2 mol-% in the head product.

4. A process according to claim 1, wherein said $C_{1+}$-hydrocarbons are scrubbed down to a residual content of 0.08–0.12 mol-% in the head product.

5. A process according to claim 1, further comprising expanding the sump product to an intermediate pressure, withdrawing thus-released intermediate pressure gaseous fraction, and feeding residual intermediate pressure liquid to the $C_{1+}$-CO separating column.

6. A process according to claim 5, further comprising heating said residual intermediate pressure liquid prior to feeding the latter to the $C_{1+}$-CO separating column.

7. A process according to claim 1, further comprising withdrawing the CO as the head product from the $C_{1+}$-CO separating column, heating said CO, compressing the heated CO, recooling the heated CO, and, in part, employing the recooled CO as reboiler heat for the separating column and, in part, for production of refrigeration in an expansion machine.

8. A process according to claim 7, further comprising introducing the CO stream condensed during heating of the separating column as reflux liquid for at least one of the scrubbing column and the $C_{1+}$-CO separating column.

9. A process according to claim 8, wherein the condensed CO stream is introduced as reflux into both columns.

10. A process according to claim 1, wherein the liquid CO, before being fed into the scrubbing column, is raised to a process pressure higher than that of the cycle CO.

11. A process according to claim 1, wherein the gaseous mixture is precooled prior to the scrubbing step.

12. A process according to claim 11, wherein during the precooling of the gaseous mixture, a precondensate enriched with $C_{1+}$-hydrocarbons is obtained and the latter is introduced separately into the $C_{1+}$-CO separating column.

13. A process according to claim 1, further comprising heating the scrubbing column at the sump by means of crude gas or cycle CO for reducing the hydrogen and carbon monoxide content in the sump product.

14. A process according to claim 5, wherein the intermediate pressure gaseous fraction is returned into the crude gaseous mixture.

* * * * *